US010029143B1

(12) United States Patent
Milstein et al.

(10) Patent No.: US 10,029,143 B1
(45) Date of Patent: Jul. 24, 2018

(54) EXERCISE BICYCLE WITH LATERALLY ADJUSTABLE PEDALS FOR INCREASING THE NUMBER OF MUSCLE GROUPS BEING CONDITIONED

(71) Applicants: Robert Milstein, Malibu, CA (US); William Jay Zemliak, Agoura Hills, CA (US)

(72) Inventors: Robert Milstein, Malibu, CA (US); William Jay Zemliak, Agoura Hills, CA (US)

( * ) Notice: Subject to any disclaimer, the term of this patent is extended or adjusted under 35 U.S.C. 154(b) by 0 days.

(21) Appl. No.: 14/790,268

(22) Filed: Jul. 2, 2015

Related U.S. Application Data

(60) Provisional application No. 62/020,637, filed on Jul. 3, 2014.

(51) Int. Cl.
*A63B 21/00* (2006.01)
*A63B 21/22* (2006.01)
(Continued)

(52) U.S. Cl.
CPC .... *A63B 22/0605* (2013.01); *A63B 21/00069* (2013.01); *A63B 21/22* (2013.01);
(Continued)

(58) Field of Classification Search
CPC ..... A63B 21/00069; A63B 21/00072; A63B 21/00185; A63B 21/068; A63B 21/08; A63B 21/159; A63B 21/22; A63B 21/4011; A63B 21/4015; A63B 21/4033; A63B 21/4034; A63B 21/4049; A63B 22/0015; A63B 22/06; A63B 22/0605; A63B 2022/0028; A63B 2022/0617; A63B 2022/0623; A63B 2022/0635; A63B 23/03508; A63B 23/03533; A63B 23/04; A63B 23/0405; A63B 23/0476; A63B 23/0482; A63B 23/0494; A63B 23/08;
(Continued)

(56) References Cited

U.S. PATENT DOCUMENTS 599,909 A * 3/1898 Latta ..... B62M 3/08 74/594.7
2,337,246 A * 12/1943 Kelly ..... B62M 3/08 74/594.7
(Continued)

*Primary Examiner* — Loan H Thanh
*Assistant Examiner* — Gary D Urbiel Goldner
(74) *Attorney, Agent, or Firm* — Malin Haley DiMaggio & Bowen, P.A.

(57) ABSTRACT

A stationary exercise bicycle pedal system that can be easily manually modified during an exercise routine to greatly expand the number of different muscle groups that are stimulated during the exercise routine. The stationary exercise bicycle pedal system includes laterally adjustable and selectively positionable pedals received on elongated support shafts. Adjustable pedal stops are received on each elongated support shaft and are provided on each side of each pedal to lock or hold the respective pedal in a specific location along the respective elongated support shaft. The adjustable pedal stops are manually adjustable along a length of the respective elongated support shaft so that the respective pedal can be selectively positioned anywhere along the respective elongated support shaft and varied during the exercise routine.

5 Claims, 4 Drawing Sheets

(51) Int. Cl.
*A63B 22/06* (2006.01)
*A63B 23/04* (2006.01)

(52) U.S. Cl.
CPC ..... *A63B 21/4034* (2015.10); *A63B 21/4049* (2015.10); *A63B 23/0476* (2013.01); *A63B 2022/0635* (2013.01)

(58) Field of Classification Search
CPC ... A63B 23/085; A63B 69/16; A63B 71/0054; A63B 2017/0072; A63B 2225/09
USPC ..... 74/594.4, 594.7
See application file for complete search history.

(56) References Cited

U.S. PATENT DOCUMENTS 2,509,457 A * 5/1950 Schwenk ..... B62M 3/08 74/562
3,307,425 A * 3/1967 Sykes ..... B62M 3/08 280/231
3,403,906 A * 10/1968 Burzenski ..... A63B 22/20 482/108
3,457,803 A * 7/1969 Sykes ..... B62M 3/08 74/594.7
4,225,130 A * 9/1980 Zimmerman ..... A63B 22/0007 482/60
4,595,197 A * 6/1986 Hagstrom ..... A63B 21/4011 482/132
4,648,287 A * 3/1987 Preskitt ..... B62M 3/02 74/594.1
4,779,481 A * 10/1988 Natzke ..... E02F 3/36 280/291
4,973,046 A * 11/1990 Maxwell ..... A63B 21/00178 482/60
5,004,229 A * 4/1991 Lind ..... A63B 22/20 482/132
5,149,312 A * 9/1992 Croft ..... A63B 22/0605 482/148
5,161,430 A * 11/1992 Febey ..... B62M 3/02 74/594.1
5,176,595 A * 1/1993 Lind ..... A63B 22/20 482/148
5,336,147 A * 8/1994 Sweeney, III ..... A63B 22/0012 482/57
5,458,022 A * 10/1995 Mattfeld ..... B62M 3/02 74/594.1
6,053,853 A * 4/2000 Hinds ..... A63B 22/20 280/205
6,575,883 B1 * 6/2003 Hinds ..... A63B 21/0004 482/125
6,688,192 B1 * 2/2004 Badarneh ..... A63B 22/16 74/560
6,802,798 B1 * 10/2004 Zeng ..... A63B 22/0015 482/57
7,097,597 B2 * 8/2006 Tamian ..... B62H 7/00 482/57
7,507,188 B2 3/2009 Nurre
8,065,933 B2 * 11/2011 Coderre ..... B62M 3/086 36/131
8,117,944 B2 * 2/2012 Stevovich ..... B62M 3/08 74/594.3
8,893,581 B2 * 11/2014 White ..... B62M 3/08 74/594.1
9,044,630 B1 * 6/2015 Lampert ..... A63B 23/035
2004/0116257 A1 * 6/2004 Balbo ..... A63B 21/16 482/60
2005/0020411 A1 * 1/2005 Andrews ..... B62M 3/02 482/63
2005/0239609 A1 * 10/2005 Chen ..... A63B 22/0605 482/57
2005/0274220 A1 * 12/2005 Reboullet ..... B62M 3/086 74/594.4
2006/0162489 A1 * 7/2006 Raad ..... B62M 3/08 74/594.7
2007/0249471 A1 * 10/2007 Nurre ..... A63B 22/0605 482/57
2009/0211395 A1 * 8/2009 Mul'e ..... B62M 3/02 74/594.7
2012/0065028 A1 * 3/2012 Gray ..... A63B 22/0605 482/57

* cited by examiner

EXERCISE BICYCLE WITH LATERALLY ADJUSTABLE PEDALS FOR INCREASING THE NUMBER OF MUSCLE GROUPS BEING CONDITIONED

CROSS REFERENCE TO RELATED APPLICATIONS

This application also claims priority to U.S. Provisional Application 62/020,637 filed on Jul. 3, 2014.

BACKGROUND OF THE INVENTION

Field of the Invention

This invention relates generally to a stationary exercise bicycle for human exercise to condition muscles and specifically to a stationary exercise bicycle that includes laterally adjustable pedals that can be individually positioned during a workout to increase the number of different muscle groups being conditioned.

Description of Related Art

The use of stationary exercise bicycles is well known in the prior art. Typically such an exercising device includes many parts that are similar to a regular bicycle including a pair of rotatable pedals that may be connected to a sprocket like device that applies tension or back force against the pedaling effort to enhance muscle conditioning. Many of the stationary exercise bicycles also includes seats and handlebar like supports for grasping with the hands during the exercise period.

One of the drawbacks of the stationary exercise bicycle is that the pedals that provide the resistance used for muscle conditioning and muscle toning are located in a fixed position relative to a user who may be sitting or standing while rotating the pedals against resistance. This means that the same muscle groups are being conditioned during each use of the stationary exercise bicycle. While this is very beneficial to the particular muscle groups that are being conditioned, it would be more beneficial to the user that during a particular exercise workout period, the user could have the benefit of conditioning and toning many different muscle groups.

The invention described herein provides a device that does allow increasing the number of different muscles and muscle groups that can be conditioned using a stationary exercise bicycle. This is accomplished by the user manually adjusting the lateral position of each pedal, i.e. the left pedal and the right pedal, at any time during an exercise workout period to different lateral positions. Changing the distance laterally of each pedal from the pedal arm causes the user's legs to change positions relative to each other and the centerline of the exercise bicycle, thereby stimulating different muscle groups, each one of which is dependent on the specific location of the pedal relative to the pedal shaft and distance from the centerline of the exercise bicycle.

SUMMARY OF THE INVENTION

Disclosed is a stationary exercise bicycle including a support frame and stabilizing stationary base, a hand gripping support device connected to the frame, a rotatable tensioning device having a left pedal and a right pedal connected to the frame, the rotatable tensioning device including a rotatable frame axle, a left pedal extension arm and a right pedal extension arm each connected to said frame axle, a left pedal support shaft and a right pedal support shaft, each connected to the left and right pedal extension arms respectively. Each pedal is rotatable as mounted on its own rigid elongated support shaft. Each pedal support shaft has an extended length and is elongated so that the pedal support shaft length can exceed the length of each pedal by at least a factor of two or more pedal lengths.

Also mounted on each side of each pedal on the pedal shaft are a pair of adjustable pedal stops that hold the pedal at a desired but changeable lateral position relative to the pedal support shaft. In some embodiments, the pair of adjustable pedal stops for each pedal can be ring fasteners that engage the pedal support shaft with set screws. In other embodiments, the adjustable pedal stops may comprise ring fasteners that engage the pedal support shaft with thumb screws, wing bolts, or other manually adjustable fastening means. Each pedal can rotate about the pedal support shaft but cannot move laterally once the pedal stops are fastened with the set screws.

To operate the stationary exercise bicycle utilizing the invention described herein, the user would determine initially at the beginning of an exercise period the specific location of the left pedal and the right pedal relative to the pedal support shaft laterally for the specific exercise time period. After exercising for a time, the user would stop and change the lateral position of each pedal on the pedal support shafts using the adjustable pedal stops. Once a new lateral position of each pedal has been established, the user can then continue the exercise for a specific time. Because the pedal locations have been changed, the user will experience a different muscle group that is being conditioned because the user's legs are spaced apart differently from the initial exercise pattern. The manual change of pedal location laterally can be continued throughout the entire exercise regime to ensure that different muscle groups are conditioned during each exercise complete routine. The user's legs and feet are being spaced apart for different exercise time periods to change muscle groups.

In an alternate embodiment, adjustable spring-activated pedal stops that are manually movable can be used to expedite the lateral positioning of each pedal during the entire exercise routine. To that end, the set screw or manually operable fastener means can be replaced with a spring loaded pin stop. The pedal support shaft can have surface grooves or apertures spaced laterally which receive a spring loaded pin within the pedal stop.

In accordance with the foregoing, it is an object of this invention to provide an improved stationary exercise bicycle that allows a user to increase the number of different muscle groups to be conditioned during a single exercise routine by the user changing the lateral spacing of each pedal of the exercise bicycle along an elongated pedal support shaft which changes the physical position of the person exercising to ensure different muscle groups are conditioned.

PREFERRED EMBODIMENT OF THE INVENTION

Figure 1:
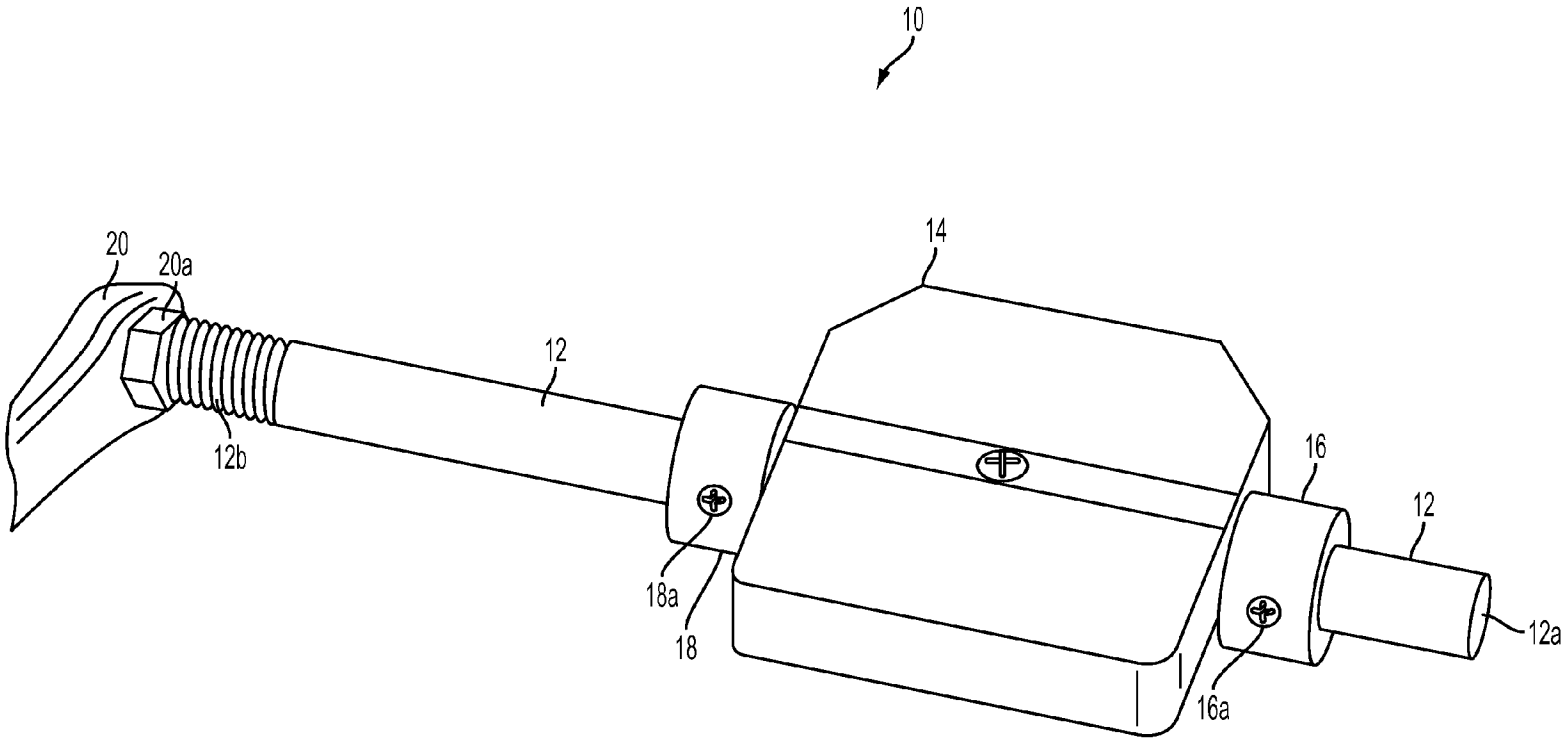
FIG. 1 shows a perspective view of one embodiment of the invention described herein.

Referring now to FIG. 1, a bicycle pedal system 10 is shown comprising a rigid elongated cylindrical pedal support shaft 12 threadably attached by threads 12*b* to a driving arm 20 that includes an attachment bolt 20*a*. The pedal support shaft 12 includes a distal end 12*a*. A pedal 14 is received on and rotatably attached to support shaft 12 at a pre-determined lateral position between driven arm 20 and the shaft distal end 12*a*. In some embodiments, the pedal 14 is secured to the shaft 12 by a pair of adjustable movable pedal stops 16 and 18 received on the pedal support shaft 12 and disposed on either side of the pedal 14. In some embodiments, the pedal stops 16 and 18 are each selectively fixable to the pedal support shaft by a set screw or threaded fastener 16*a* and 18*a* respectively. In other embodiments, wing bolts or other manually-operable fastener means may be employed which obviate the need for a screwdriver to release the pedal stops 16 and 18 for adjustment. The pedal fasteners 16 and 18, when tightened, are used to firmly hold the pedal in a fixed lateral position on the shaft for a portion of an exercise workout. This fixed configuration does not restrict the ability of the pedal to spin or rotate about the pedal support shaft 12.

The person exercising can at various time periods during the exercise routine stop pedaling and manually loosen set screws 16*a* and 18*a* which allow the cylindrical ring stops 16 and 18 and the pedal 14 to be adjusted laterally along the shaft 12. Accordingly, the pedal 14 is selectively positionable along the length of the pedal support shaft 12. When the person exercising has moved pedal 14 to a new location between the driven arm 20 and the shaft proximal end 12*a*, the person exercising can then tighten screws 16*a* and 18*a* in the new position, thereby affixing the pedal 14 to a desired position on along the pedal support shaft 12, effectively changing the lateral location of pedal 14 during an exercise routine.

Figure 2:
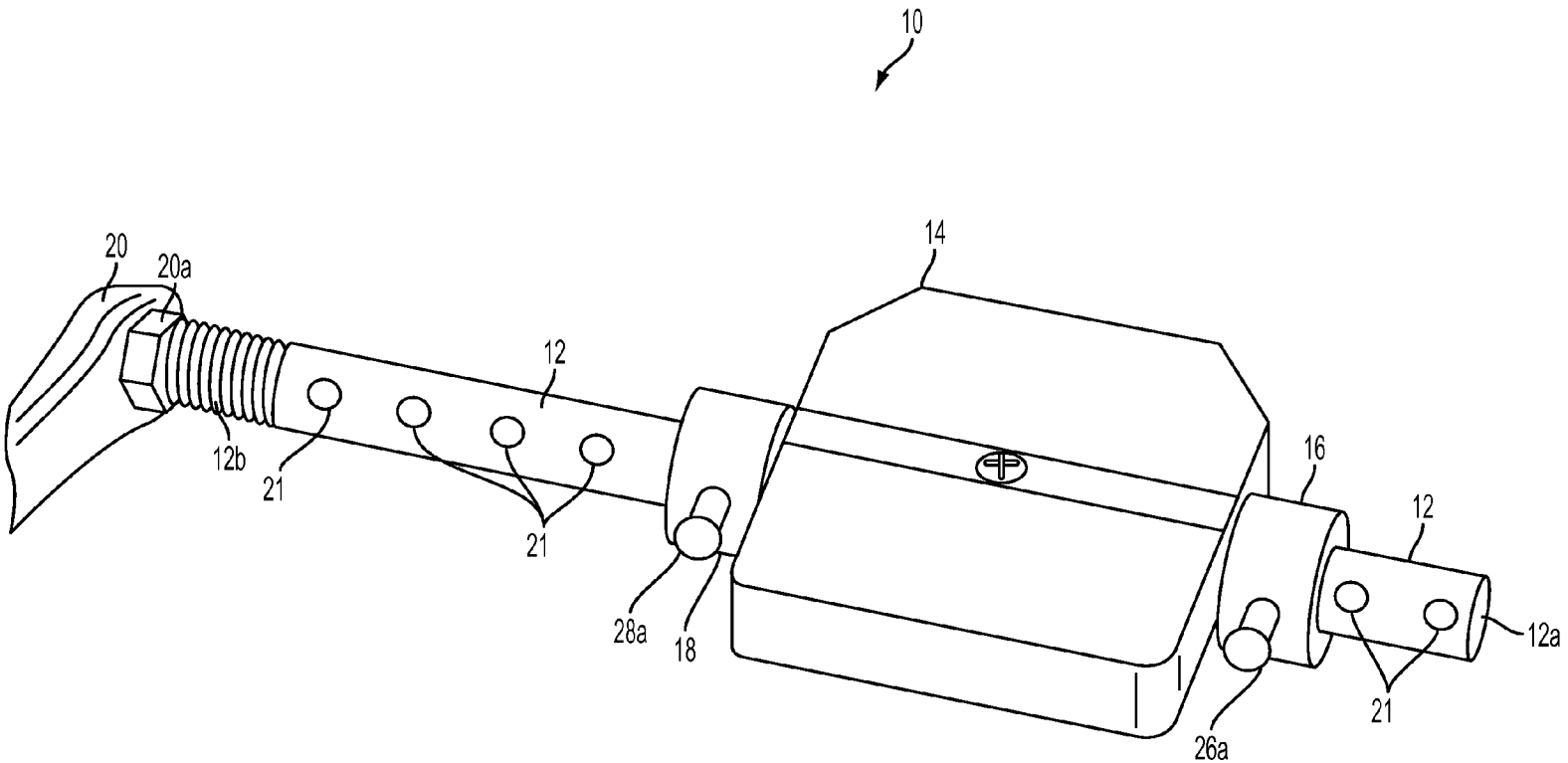
FIG. 2 shows a perspective view of an alternative embodiment of the invention described herein.

Although in FIG. 1, the pedal 14 is shown held in position by stops 16 and 18, each one of which has a set screw or fastener means that can contact shaft 12 exterior, locking the stop 16 and 18 in place (with a screwdriver), in an alternate embodiment, shown in FIG. 2, a spring-loaded pin stop 26*a* and 28*a* could be used on each side that has a spring loaded pin that also engages the exterior of shaft 12 so that the stop 16 and 18 could be easily moved without a screwdriver, merely by manually pulling up on a spring-loaded pin on each side of the pedal. In this embodiment, the shaft 12 includes pin receiving grooves or apertures 21 for that receive the pin and secure each stop 16 and 18 to the shaft in a desired position.

Figure 3A:
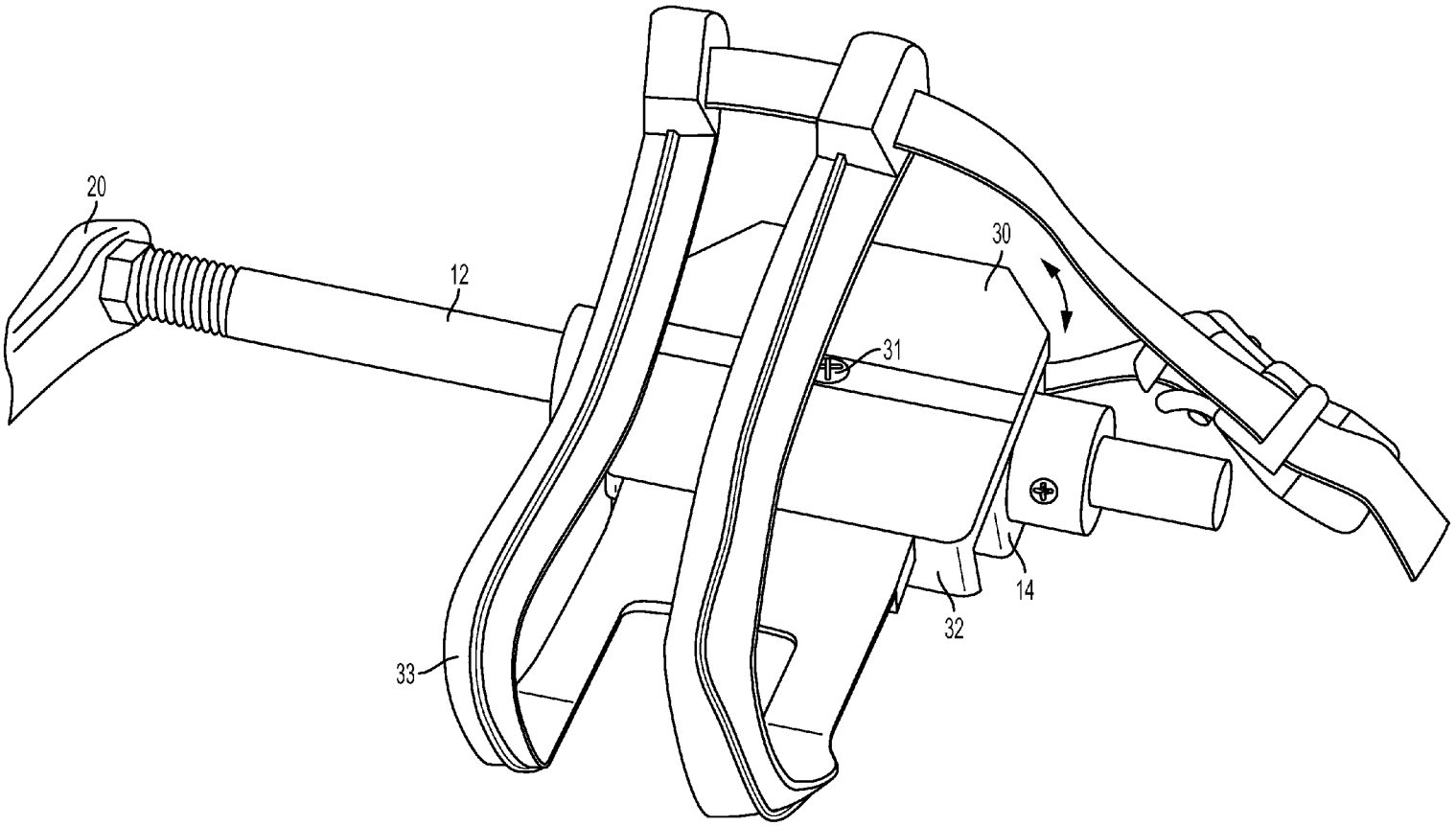
FIG. 3A shows a perspective view an alternative embodiment of the invention described herein, having a rotating pedal bracket in a first position.
Figure 3B:
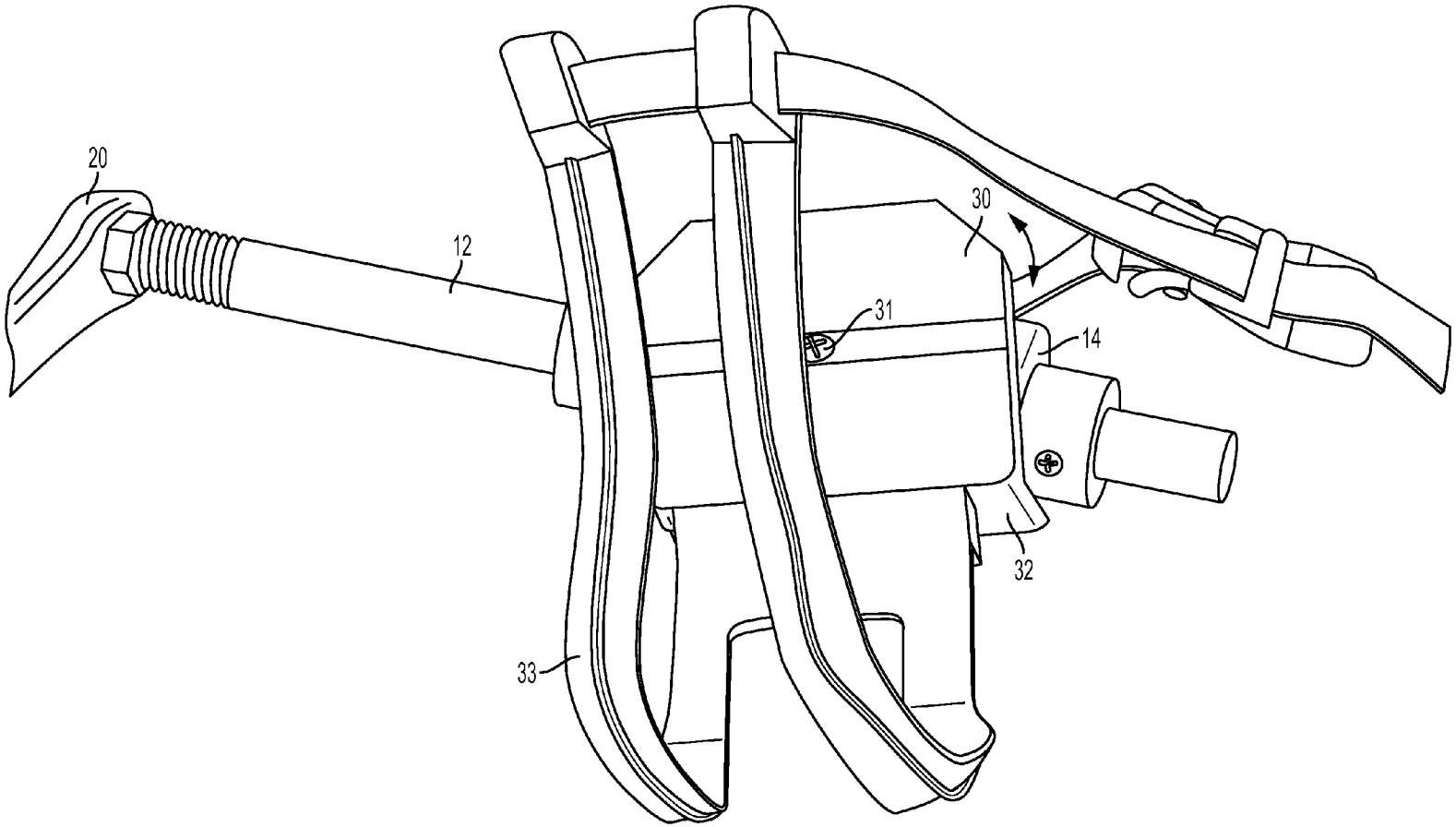
FIG. 3B shows a perspective view an alternative embodiment of the invention described herein, having a rotating pedal bracket in a second position.

FIGS. 3A and 3B depict another embodiment of the pedal system 10 having additional adjustment features. A pedal bracket 30 is rotatably mounted on top of pedal 14 by way of a center fastener 31 that may comprise a screw or bolt that is preferably adjustable. In some embodiments, the pedal bracket 30 includes a front lip 32 that overhands at the front of the pedal 14 and provides a mounting surface for toe clip 33. The pedal bracket 30 is configured to allow the user to adjust the angle of the pedal bracket 30 with respect to the shaft 12 in order to further enhance the adjustability of the system 10 and, therefore, the ability to work different muscle groups, as well as increase comfort and ergonomics. In FIG. 3A, the pedal bracket 30 is shown in a substantially centered position about pedal 14, providing a conventional configuration wherein the pedal is substantially perpendicular to the shaft 12. In FIG. 3B, the pedal bracket 30 has been rotated about a vertical axis running through the pedal 14 such that the pedal bracket 30 is at an offset angle with respect to shaft 12. The center fastener 31 can be tightened or loosened on-demand by the user to move the pedal bracket 30 through a plurality of angles with respect to shaft 12 in order to enhance muscle group availability and comfort when used in conjunction with the adjustability of the entire pedal 14 along the shaft 12.

The length of elongated rigid pedal support shaft is made to greatly exceed pedal 14 length to allow extended pedal locations. By changing the pedal 14 locations laterally along the extra-long shaft 12 which can be up to three or four times in length relative to the length of the pedal 14 allows for a larger number of different positions for each pedal 14 during an exercise routine. Spreading the legs and feet apart of the user with the pedal positions at different distances conditions different muscle groups. Accordingly, the purpose of the invention is to allow a person using an bicycle to vary the activation of muscle groups and exercise more muscle groups during a single routine by changing the lateral displacement of each pedal (left and right pedal) on an stationary exercise bicycle at different time periods in the single routine causing the user's legs to be spread further apart or closer together causing different muscle groups to be stimulated during the exercise routine. Additionally, the activation of muscle groups can be further varied by adjusting the angle of the pedal bracket 30 with respect to the shaft 12. The angle of the pedal bracket 30 may also be varied in order to enhance comfort depending on the desired location of the pedal 14 on shaft 12, i.e. if the pedal 14 is in an outer position, it may desired to angle the pedal bracket 30 slightly outward as shown in FIG. 3B in order to fit the natural anatomy of the user.

It is appreciated that the present pedal system 10 can be utilized in connection with a plurality of bicycle and bicycle-like systems including traditional mobile bicycles, recumbent bicycles, stationary upright bicycles, stationary recumbent bicycles, hand-bicycles, and various other human-powered mobile and stationary exercise equipment. To that end, the design of the pedal system 10 is not to be construed as limited to any particularly engagement or orientation with the crank or other rotary means of the device to which it is attached. Additionally, the size, shape and materials used for the various components of the present invention can vary as would be appreciated by one with skill in the art.

While specific embodiments have been described in detail in the foregoing detailed description and illustrated in the accompanying drawings, those with ordinary skill in the art will appreciate that various modifications and alternatives to those details could be developed in light of the overall teaching of the disclosure. Accordingly, the particular arrangements disclosed are meant to be illustrative only and not limiting as to the scope of the invention, which is to be given the full breadth of the appended claims in any and all equivalents thereof.

What is claimed is:

1. A stationary bicycle pedal system that includes a shank to attach a pedal support shaft and a pedal in order to allow a user to exercise different muscles and different muscle groups by changing a lateral position of said pedal along said pedal support shaft, said stationary bicycle pedal system comprising: said pedal support shaft attachable to said shank; said pedal rotatably attached to said pedal support shaft and movable laterally along said pedal support shaft, said pedal having two opposing sides through which said pedal support shaft extends; said pedal support shaft being sized in a length exceeding a length of said pedal by a factor of two or more pedal lengths; and a pair of pedal stops adjustably fixable to and laterally positionable along the length of said pedal support shaft, wherein each pedal stop is respectively mounted on one of the two opposing sides of said pedal on said pedal support shaft, to allow positioning of the pedal along the pedal support shaft, whereby the user can select lateral positions of the pedal along the pedal support shaft during different exercise sessions to exercise the different muscles and the different muscle groups resulting from varying distances separating the user's feet resting on the pedals.

2. The bicycle pedal system of claim 1, wherein each of said pedal stops are selectively fixed to said pedal support shaft by a set screw.

3. The bicycle pedal system of claim 1, wherein the length of said pedal support shaft is three times greater than the length of said pedal.

4. The bicycle pedal system of claim 1, wherein the length of said pedal support shaft is four times greater than the length of said pedal.

5. A method for varying activation of muscle groups during exercise by providing a stationary bicycle pedal system comprising a pedal laterally slidably movable and fixable at a desired lateral location along a pedal support shaft, said pedal support shaft being at least two pedal lengths in length, and said pedal having two opposing sides through which said pedal support shaft extends; said stationary bicycle pedal system further comprising a pair of pedal stops received on and laterally adjustable along a length of said pedal support shaft, wherein each pedal stop is respectively disposed on one of the two opposing sides of said pedal, wherein said pair of pedal stops are configured to be selectively fixed to said pedal support shaft so as to affix said pedal to said desired lateral location on said pedal support shaft, said pedal support shaft extending and sized in length to exceed two pedal lengths; said method further comprising a step of moving and fixing said pedal to said desired lateral location along said pedal support shaft to provide activation of particular muscles and muscle groups during the exercise resulting from varying distances separating the user's feet resting on the pedals.

* * * * *